US008151900B2

(12) United States Patent
Piras

(10) Patent No.: US 8,151,900 B2
(45) Date of Patent: Apr. 10, 2012

(54) PERCUSSION EQUIPMENT DRIVEN BY A PRESSURIZED INCOMPRESSIBLE FLUID

(75) Inventor: Bernard Piras, Vernaison (FR)

(73) Assignee: Montabert, Saint Priest (FR)

( * ) Notice: Subject to any disclaimer, the term of this patent is extended or adjusted under 35 U.S.C. 154(b) by 383 days.

(21) Appl. No.: 12/227,768

(22) PCT Filed: Jun. 27, 2007

(86) PCT No.: PCT/FR2007/001082

§ 371 (c)(1),
(2), (4) Date: Feb. 26, 2009

(87) PCT Pub. No.: WO2008/000958

PCT Pub. Date: Jan. 3, 2008

(65) Prior Publication Data

US 2009/0250234 A1 Oct. 8, 2009

(30) Foreign Application Priority Data

Jun. 27, 2006 (FR) ..... 06 05764

(51) Int. Cl.
*B25D 9/14* (2006.01)

(52) U.S. Cl. ..... 173/13; 173/14; 173/135; 173/136; 91/300; 91/303; 91/321; 91/323; 91/277; 251/318; 251/321; 251/28; 251/31; 137/625

(58) Field of Classification Search ..... 173/13–14, 173/135–136, 206; 91/300, 303, 321, 323, 91/277; 251/318, 321, 26, 28, 31; 137/625
See application file for complete search history.

(56) References Cited

U.S. PATENT DOCUMENTS

| | | | | |
|---|---|---|---|---|
| 4,020,746 | A * | 5/1977 | Arndt | 91/291 |
| 4,858,702 | A * | 8/1989 | Piras | 173/208 |
| 4,899,836 | A | 2/1990 | Vernot | |
| 5,669,281 | A * | 9/1997 | Comarmond | 91/245 |
| 5,890,548 | A * | 4/1999 | Juvonen | 173/208 |
| 7,040,215 | B2 * | 5/2006 | Bruck | 91/435 |
| 7,779,930 | B2 * | 8/2010 | Lohmann et al. | 173/177 |
| 7,861,641 | B2 * | 1/2011 | Weddfelt | 91/321 |

FOREIGN PATENT DOCUMENTS

| | | | |
|---|---|---|---|
| EP | 0 214 064 | A1 | 3/1987 |
| EP | 0 236 721 | A2 | 9/1987 |
| EP | 0 256 955 | A1 | 2/1988 |
| EP | 0 688 636 | A1 | 12/1995 |
| EP | 0 715 932 | B1 | 6/1996 |
| FR | 2 375 008 | A1 | 7/1978 |
| JP | 03104570 | A * | 5/1991 |

(Continued)

*Primary Examiner* — Brian D Nash
*Assistant Examiner* — Michelle Lopez
(74) *Attorney, Agent, or Firm* — Oliff & Berridge, PLC

(57) ABSTRACT

A percussion apparatus driven by a pressurized incompressible fluid includes a body with two coaxial bores for slidably mounting of a tool, and separately slidably mounting a striking piston having a stepped configuration. A control device varies a stroke of the striking piston between a long and a short stroke, and is connected to the directional flow valve and to a bottom chamber of the piston cylinder. The control device includes a cylinder in which a spool is mounted. A first face of the spool is situated in a first chamber permanently subjected to a determined pressure, and a second face of the spool is situated in a second chamber connected to the braking chamber for controlling the varying of the stroke of the striking piston.

11 Claims, 16 Drawing Sheets

FOREIGN PATENT DOCUMENTS

| | | | | |
|---|---|---|---|---|
| JP | 03184777 | A | * | 8/1991 |
| WO | WO 2005/000532 | A1 | | 1/2005 |
| WO | WO 2005/058550 | A1 | | 6/2005 |
| WO | WO 2006007811 | A1 | * | 1/2006 |

* cited by examiner

PERCUSSION EQUIPMENT DRIVEN BY A PRESSURIZED INCOMPRESSIBLE FLUID

The subject of the present invention is a percussion apparatus driven by a pressurized incompressible fluid.

Percussion apparatus driven by a pressurized incompressible fluid is supplied with fluid, such that the resultant of the hydraulic forces being applied successively to the striking piston, moves the latter reciprocally in one direction and then the other.

In apparatus of this type, the piston moves reciprocally inside a bore or cylinder in which are arranged at least two antagonistic chambers of different cross sections. One, constantly supplied with pressurized fluid, called the bottom chamber, ensures that the piston rises and another antagonistic chamber of larger cross section, called the top chamber, is supplied reciprocally with pressurized fluid when the accelerated stroke of the piston for striking is connected to the return circuit of the apparatus when the piston rises. As a general rule, the apparatus is also furnished with a chamber, called the braking chamber, which serves to hydraulically stop the stroke of the piston when the tool is not resting on the material to be destroyed. There is therefore never any metallic impact between the striking piston and the cylinder. This braking chamber may advantageously be arranged in the extension of the annular rising chamber.

When the apparatus works in uniform hard ground, it is known that it is preferable to favor the energy per strike relative to the frequency in order to obtain optimum productivity.

On the other hand, it is also known that, if the tool is not correctly pressed on the material to be destroyed or if the material is too soft, the apparatus will have a tendency to strike on the tool "air shots" that are very destructive for the tool and the apparatus itself. Since the power of the apparatus is expressed by the product of the strike frequency value and the shot energy value, at a constant input hydraulic power, it is advantageous to reduce the energy per shot and consequently to increase the strike frequency when the apparatus has a tendency to strike air shots.

Energy per shot is the kinetic energy given to the piston, which depends on the striking stroke and the supply pressure.

To adjust the strike frequency and the energy per shot suitable to the hardness of a given ground, there are at least three known solutions described in patents EP 0 214 064, EP 0 256 955 and EP 0 715 932 in the name of the applicant.

Patent EP 0 214 064 describes an apparatus that makes it possible to obtain an automatic adaptation of the percussion parameters, thanks to the presence in the cylinder of the apparatus of a channel supplied with fluid according to the position of the piston after the impact and the possible rebound of the latter on the tool.

Patent EP 0 256 955 describes an apparatus which makes it possible to obtain the same result, according to the pressure variations in the top chamber or the bottom chamber, as a result of the rebound effect of the piston on the tool, thanks to the presence of the hydraulic element sensitive to these variations.

Patent EP 0 715 932 describes a simplified system that can be fitted to low- and medium-power apparatus. This system consists, during the rebound phase of the piston following the impact, in determining the possible existence of an instantaneous flow of fluid flowing from the top chamber to the supply circuit and in using this signal to control the percussion parameters such as the strike pressure or the frequency of the apparatus.

These three cases are systems well suited to sophisticated equipment that change in very nonuniform and very varied ground, but that are considered too costly for uses of an apparatus in uniform ground.

The object of the invention is to provide a percussion apparatus driven by a pressurized incompressible fluid that is simple, reliable and not very costly, while making it possible to protect the apparatus against air shots.

Accordingly, the invention relates to a percussion apparatus driven by a pressurized incompressible fluid, comprising:

- a body inside which are arranged two coaxial bores: one bore serving for the slidable mounting of a tool and a bore that is stepped, that is to say comprising different successive cross sections, forming a cylinder for a stepped piston, the piston being able to be moved in a reciprocating manner inside the cylinder and coming, during each cycle, to strike the tool, the piston delimiting with the cylinder at least one top chamber and a bottom chamber supplied sequentially with an incompressible fluid under high pressure, under the action of a directional flow valve,
- a network of channels leading into the cylinder, of which certain may, depending on their function, be connected through the directional flow valve to the high-pressure network and/or low-pressure network, depending on the moment in question of the operating cycle,
- a control device making it possible to vary the stroke of the striking piston between a long stroke and a short stroke and vice-versa, the control device being connected on the one hand to the directional flow valve and on the other hand to at least one channel leading into the cylinder of the striking piston and capable of being placed in communication with the bottom chamber during the upward movement of the striking piston,
- a braking chamber placed in a zone of the cylinder situated on the side of the tool, capable of being closed by a shoulder of the piston when the piston moves past its theoretical striking position, characterized in that the control device comprises a cylinder, into which at least one channel leads, also leading into the cylinder of the striking piston and a channel connected to the directional flow valve, and in which a spool is mounted whereof a first face is situated in a first chamber permanently subjected to a determined pressure, and whereof the second face is situated in a second chamber connected to the braking chamber.

Specifically this involves making use of the braking chamber so that it fulfills a new function consisting in acting on the means for controlling the stroke of the piston. The result of this is that it is not necessary to provide specific means for acting on the means for controlling the stroke of the piston. Accordingly, the apparatus according to the invention is more simple, reliable and less costly.

Advantageously, the first face of the spool of the control device is subjected to the action of a spring while the second face is subjected to the pressure prevailing in the braking chamber, the latter being in communication with an adjacent annular chamber arranged in the cylinder, while the piston has not moved past its theoretical striking position, the annular chamber being connected to the high pressure.

According to another feature of the invention, a calibrated orifice, consisting of a nozzle, is placed on the channel connecting the braking chamber and the second chamber of the control device.

According to yet another feature of the invention, a nonreturn valve is placed on the channel connecting the braking chamber and the second chamber of the control device, and this second chamber is connected via a channel comprising a calibrated orifice consisting of a nozzle, to the channel connecting the control device to the directional flow valve.

According to another alternative of the invention, the first chamber of the control device is permanently connected to a high-pressure circuit via a channel comprising a calibrated orifice consisting of a nozzle.

Advantageously, the first chamber of the control device is permanently connected to the high-pressure circuit via a channel leading into the bottom chamber of the cylinder of the striking piston.

According to one feature of the invention, the first chamber of the control device is permanently connected to the high-pressure circuit via a channel connected to the source of supply with fluid under high pressure.

Preferably, the cylinder of the control device comprises several different successive cross sections, and the spool comprises several different successive cross sections, the spool and the cylinder delimiting an annular chamber permanently connected to the directional flow valve, the spool being arranged in order to allow, during its movement under the effect of the fluid originating from the braking chamber, the placing in communication of the annular chamber with the other channel(s) leading into the cylinder of the striking piston.

According to another feature of the invention, the spool of the control device comprises a central bore in which is slidingly mounted a piston comprising two successive sections of different diameters, a large diameter on the side of the first chamber and a small diameter on the side of the second chamber, an annular chamber being arranged in the central zone of the spool, between the latter and the central piston, this annular chamber being permanently connected with the annular chamber of the spool connected to the directional flow valve, the latter also being connected to the second chamber via a channel comprising a calibrated orifice, and the piston end with the small cross section being placed opposite the channel connecting the second chamber to the braking chamber.

According to another alternative of the invention, the spool of the control device comprises a central bore in which is slidingly mounted a piston comprising two successive sections of different diameters, a large diameter on the side of the first chamber and a small diameter on the side of the second chamber, an annular chamber being arranged in the central zone of the spool, between the latter and the central piston, this annular chamber being permanently connected with an annular chamber of the spool constantly connected to the low-pressure circuit, the latter also being connected to the second chamber via a channel comprising a calibrated orifice, and the piston end with the small cross section being placed opposite the channel connecting the second chamber to the braking chamber.

According to yet another alternative of the invention, the spool of the control device comprises a central bore in which is slidingly mounted a piston comprising two successive sections of different diameters, a large diameter on the side of the first chamber and a small diameter on the side of the second chamber, an annular chamber being arranged in the central zone of the spool, between the latter and the central piston, this annular chamber being permanently connected with an annular chamber of the spool constantly connected to the low-pressure circuit, the second chamber being connected to the first chamber via a channel comprising a calibrated orifice and the piston end with the small cross section being placed opposite the channel connecting the second chamber to the braking chamber.

In any case, the invention will be fully understood with the aid of the following description made with reference to the appended schematic drawing representing, as nonlimiting examples, several embodiments of this apparatus.

Figure 1:
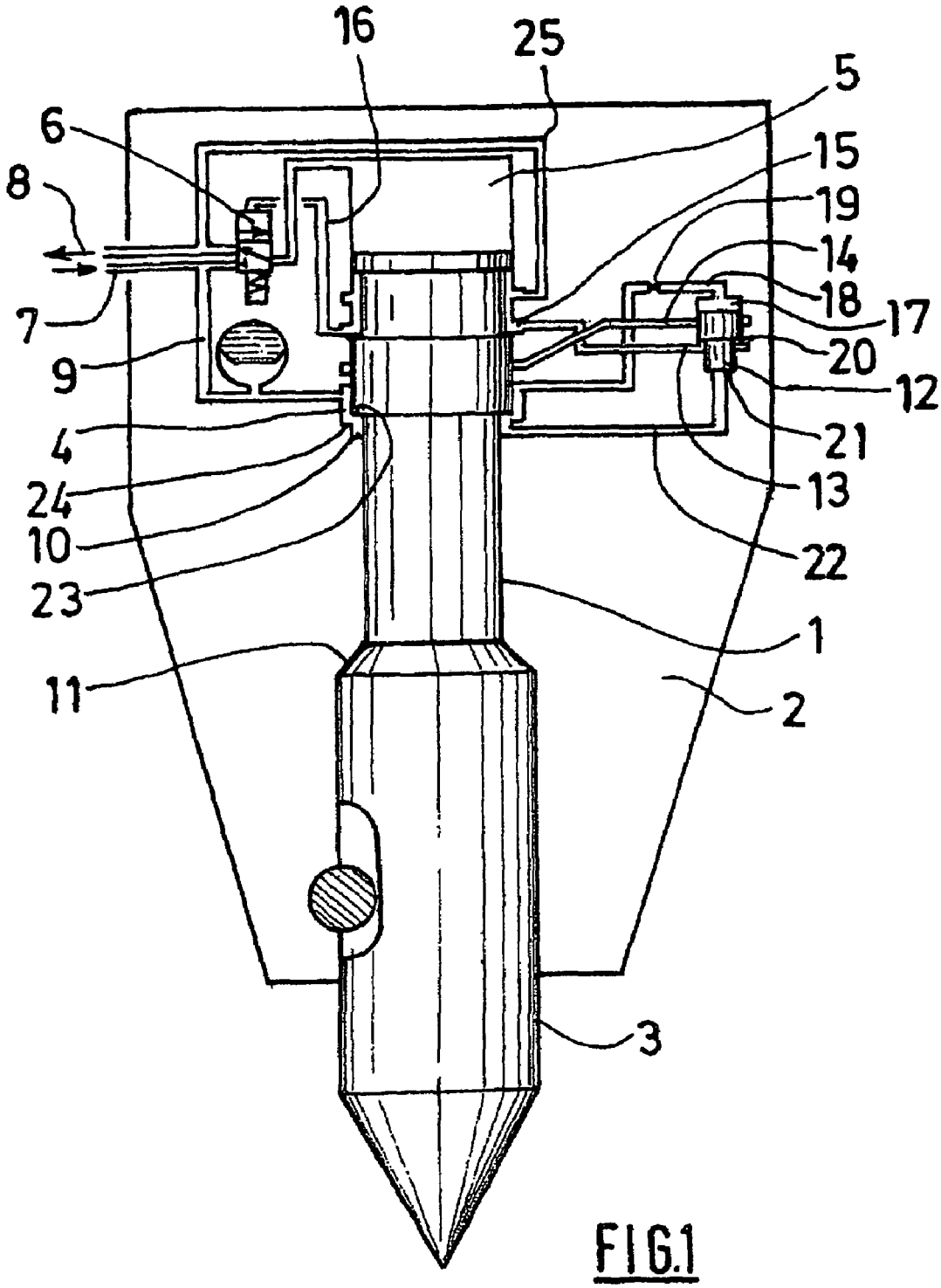
FIG. 1 represents a view in longitudinal section of a first apparatus.

The apparatus represented in FIGS. 1 to 4 is a percussion apparatus driven by a pressurized incompressible fluid between a long stroke and a short stroke and vice-versa.

The percussion apparatus comprises a staged piston 1 that can be moved reciprocally inside a staged bore or cylinder arranged in the body 2 of the apparatus, and coming to strike on each cycle a tool 3 mounted slidingly in a bore arranged in the body 2 coaxially with the cylinder. The piston 1 delimits with the cylinder 2 a bottom annular chamber 4 and a top chamber 5 of larger cross section arranged above the piston.

Figure 2:
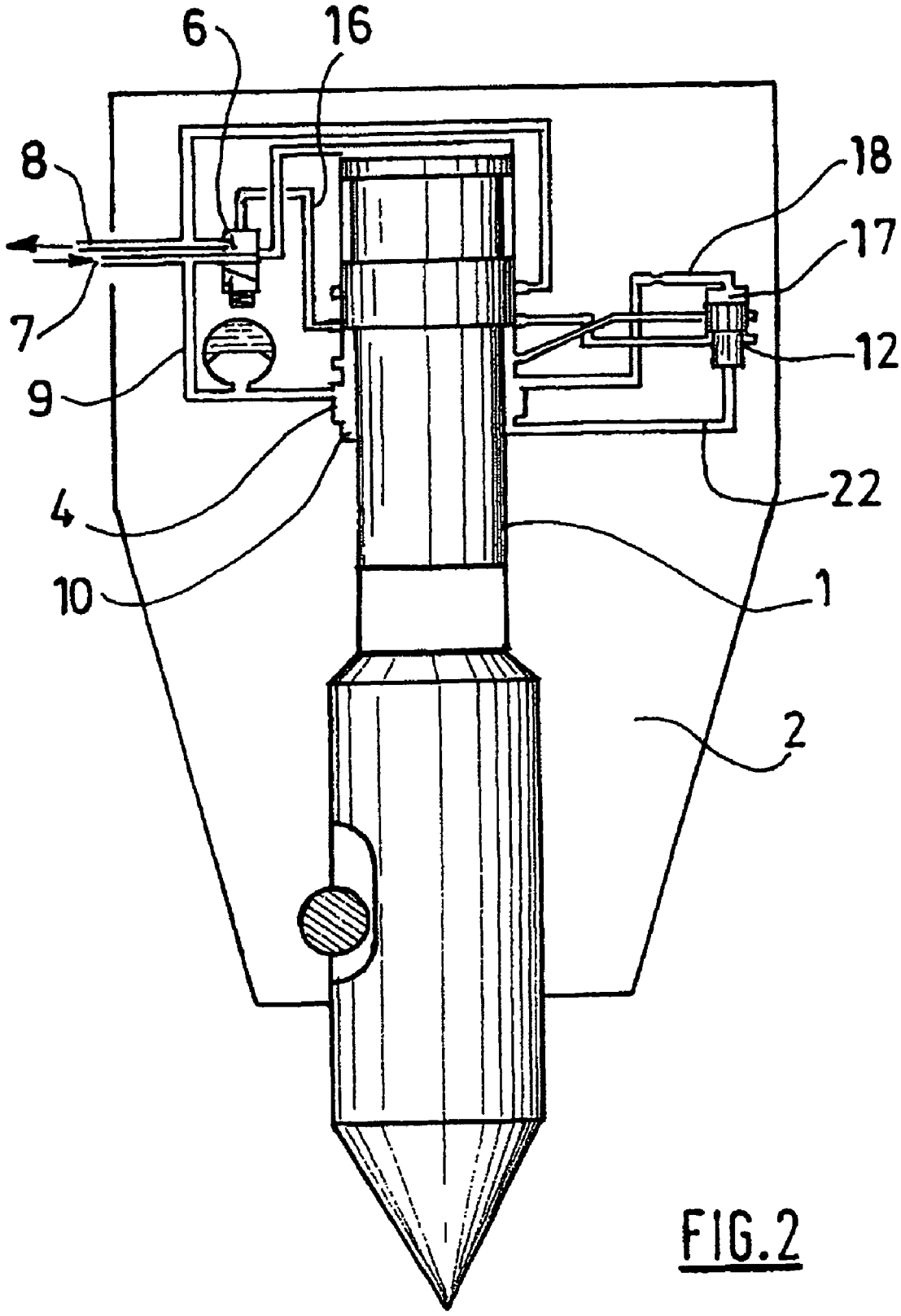
FIGS. 2, 3 and 4 represent views in longitudinal section of this apparatus in other operating positions.

A main directional flow valve 6 mounted in the body 2 makes it possible to place the top chamber 5 alternatively in relation with a high-pressure fluid supply 7 during the accelerated downstroke of the piston for the strike, as shown in FIG. 2, or with a low-pressure circuit 8 during the upstroke of the piston as shown in FIG. 1.

The annular chamber 4 is permanently supplied with fluid under high pressure via the channel 9, so that each position of the spool of the directional flow valve 6 causes the strike stroke of the piston 1, then the upstroke.

The piston 1 also forms with the body 2 an annular chamber 10, called the braking chamber, arranged in the extension of the bottom chamber 4 and supplied with fluid under high pressure by the latter. The braking chamber makes it possible, by the "DASH POT" principle, to dissipate the strike energy of the piston 1 when the tool 3 is not close to its theoretical operating position, that is to say pressing on the conical portion 11 of the body 2.

The choice of the small or large strike stroke is based on a control device. The control device comprises a spool 12 mounted in a cylinder arranged in the body 2 and into which, axially offset, lead two channels 13 and 14 also leading into the cylinder of the piston 1. The channel 13 is connected to a control section of the main directional flow valve 6 by means of an annular groove 15 and a channel 16. The channel 14 leads into the cylinder containing the piston 1 and serves as a control channel of the main directional flow valve 6 in the case of a short stroke. The control device may, depending on the position of the stroke-selector spool 12, connect the channels 13 and 14 or keep them isolated from one another.

According to the invention, the spool 12 delimits with the body 2 three distinct chambers. A chamber 17 constantly connected to the fluid under high pressure by means of the channel 18 containing a calibrated orifice 19, and by means of the annular chamber 4 and the channel 9. An annular chamber 20 subjected to the control pressure of the channel 13 and finally a chamber 21 opposite to the chamber 17 is connected to the braking chamber 10 via a channel 22.

In the diagram representing the apparatus, the control pressure transmitted via the channel 16 to the main directional flow valve 6 is equal to the supply pressure during the accelerated downstroke of the striking piston 1 and equal to the return pressure during the upstroke of the same piston. The changes of pressure occur thanks to the edges of the striking piston 1; these pressures are maintained during the movement of the piston by calibrated orifices not shown because they form an integral part of the main directional flow valve 6.

When the apparatus is working in hard uniform ground, the tool 3 remains close to its bearing surface 11 under the effect of the pressure exerted by the carrying machine on the apparatus. With each impact, the edge 23 of the piston 1 does not pass the edge 24 of the bottom chamber 4. The pressures established in the annular chambers 4 and 10 are therefore identical and equal to the supply pressure.

The pressure that is established in the chamber 20 is therefore either equivalent to or less than that established in the chambers 17 and 21.

The spool 12 is at equal pressure or pushed downward and therefore takes a position that isolates the circuits 13 and 14. Only the long stroke controlled directly via the channel 16 is possible.

FIG. 1 represents the apparatus when the piston 1 has made an impact and is beginning its upstroke.

When the piston makes an impact on the tool, the channel 16 is connected to the low-pressure circuit 8 by means of the channel 25 and of the annular groove 15, which causes a movement of the spool of the directional flow valve 6 into the position shown in FIG. 1. The result of this is that the top chamber 5 becomes connected to the low-pressure circuit 8. The resultant of the hydraulic forces applied to the striking piston therefore moves the latter in the upward direction.

FIG. 2 represents the apparatus when the piston 1 has finished its upstroke and is beginning its downstroke.

When the piston finishes its upstroke, the channel 16 is connected to the high-pressure circuit 7 by means of the channel 9 and of the bottom chamber 4, which causes a movement of the spool of the directional flow valve 6 into the position shown in FIG. 2. The result of this is that the top chamber 5 becomes connected to the high-pressure circuit 7. The resultant of the hydraulic forces applied to the striking piston moves the latter in the striking direction.

It should be noted that, when the apparatus works in hard uniform ground, the spool 12 isolates the channels 13 and 14.

Figure 3:
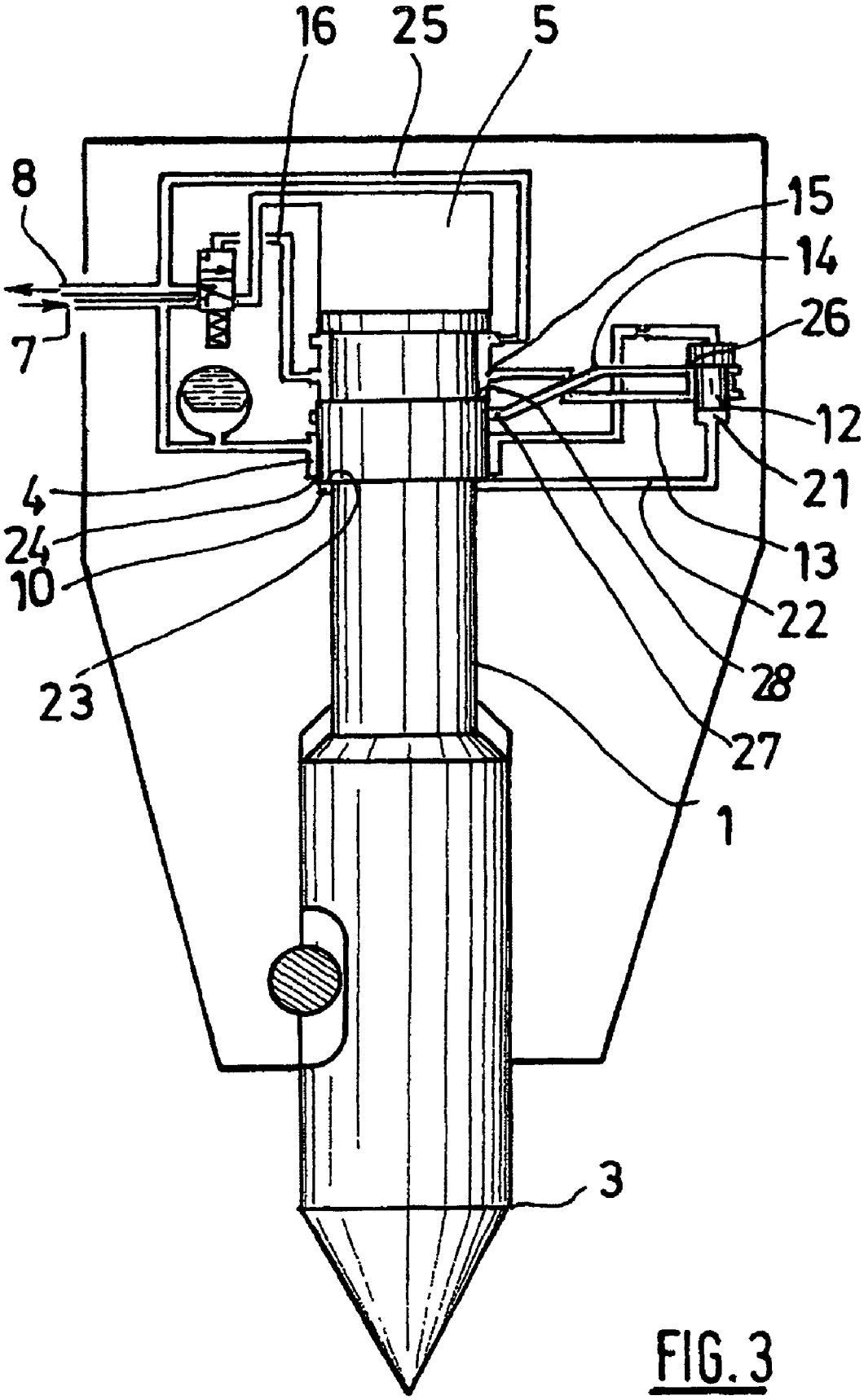
Figure 4:
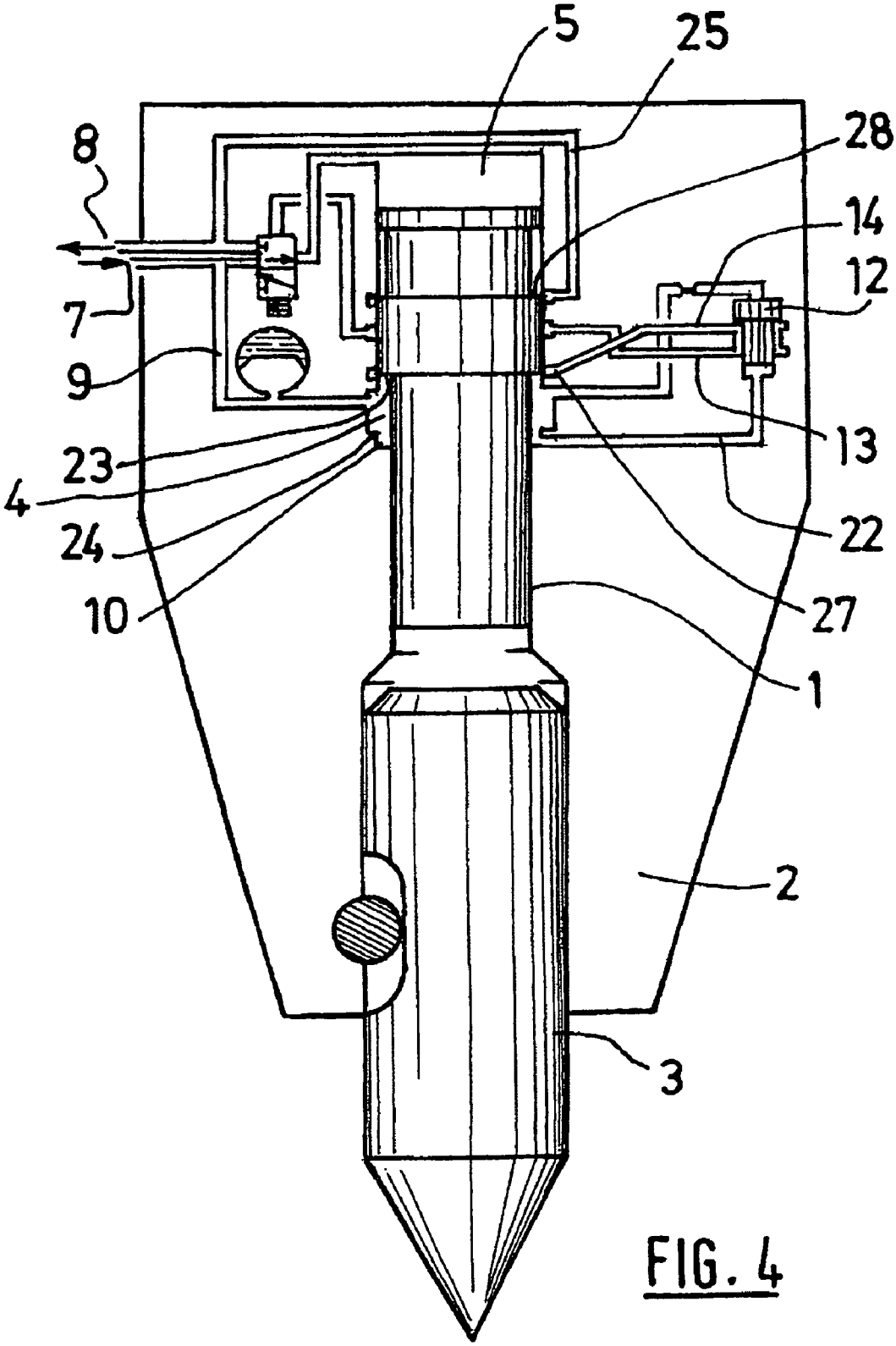

On the other hand, as shown in FIGS. 3 and 4, when the apparatus works in very soft ground or with a lack of pressure from the carrying machine, the tool 3 is no longer close to its theoretical striking position, forcing the striking piston 1 to naturally lengthen its strike stroke. In this case, the edge 23 of the striking piston 1 passes the edge 24 of the bottom chamber 4, the chamber 10 is then isolated and its pressure will increase considerably (the pressurized fluid can escape only through the very small functional clearances) causing a sudden slowing of the striking piston and a rise in pressure in the chamber 21 by means of the channel 22. The spool 12 is then unbalanced upward and creates a communication between the channels 13 and 14 when the edge 26 of the spool 12 uncovers the channel 14. The short stroke controlled by the channel 14 is then selected, as shown in FIG. 3 when the piston 1 begins its upstroke.

Then, during its upstroke, the edge 23 of the piston uncovers the annular groove 27 which is connected to the high-pressure circuit 7 by means of the channel 9 and the bottom chamber 4. The channels 13, 14 and 16 are therefore equally connected to the high-pressure circuit, which causes a movement of the spool of the directional flow valve 6 into the position shown in FIG. 4. The result of this is that the top chamber 5 is connected to the high-pressure circuit 7 and therefore that the piston begins its accelerated downstroke as shown in FIG. 4.

Then, when the edge 28 of the piston uncovers the annular groove 15, the channel 16 is connected to the low-pressure circuit 8 by means of the channel 25 and the groove 15, which causes a movement of the spool of the directional flow valve 6 into the position shown in FIG. 3. The result of this is that the top chamber 5 is connected to the low-pressure circuit 8 and therefore that the striking piston begins its accelerated upstroke.

The orifice 19 positioned on the circuit 18 has the function of limiting the speed of movement of the spool 12, thereby preventing any impacts at the end of the stroke.

The return to the bottom position of the spool 12 takes place progressively over several cycles, when the edge 23 of the piston 1 no longer passes the edge 24 of the bottom chamber 4, each time the control channel 13 is connected to the low pressure either via the striking piston 1, or via the main directional flow valve system 6.

Figure 5:
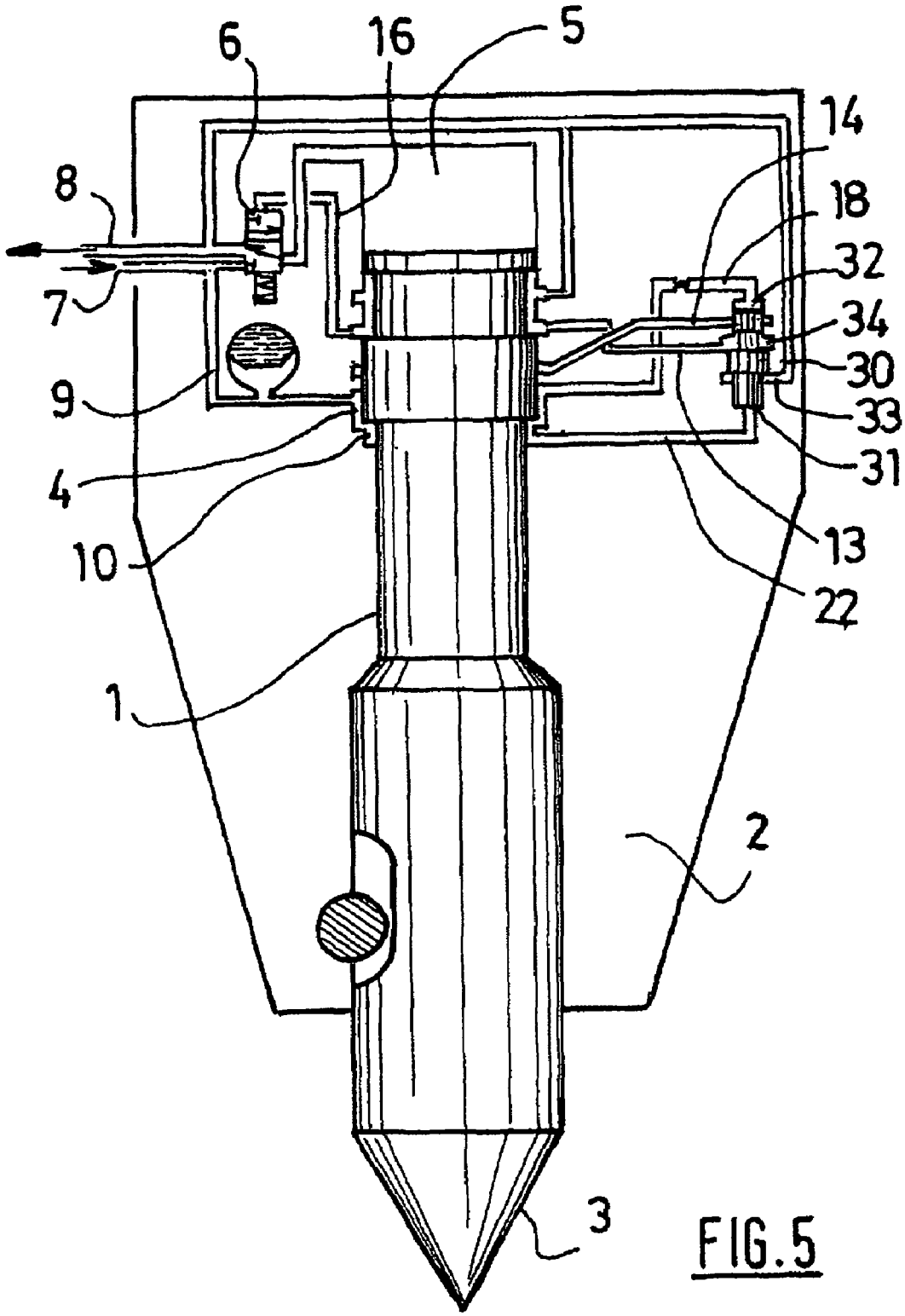
FIG. 5 represents a view in longitudinal section of a variant of the same apparatus.
Figure 6:
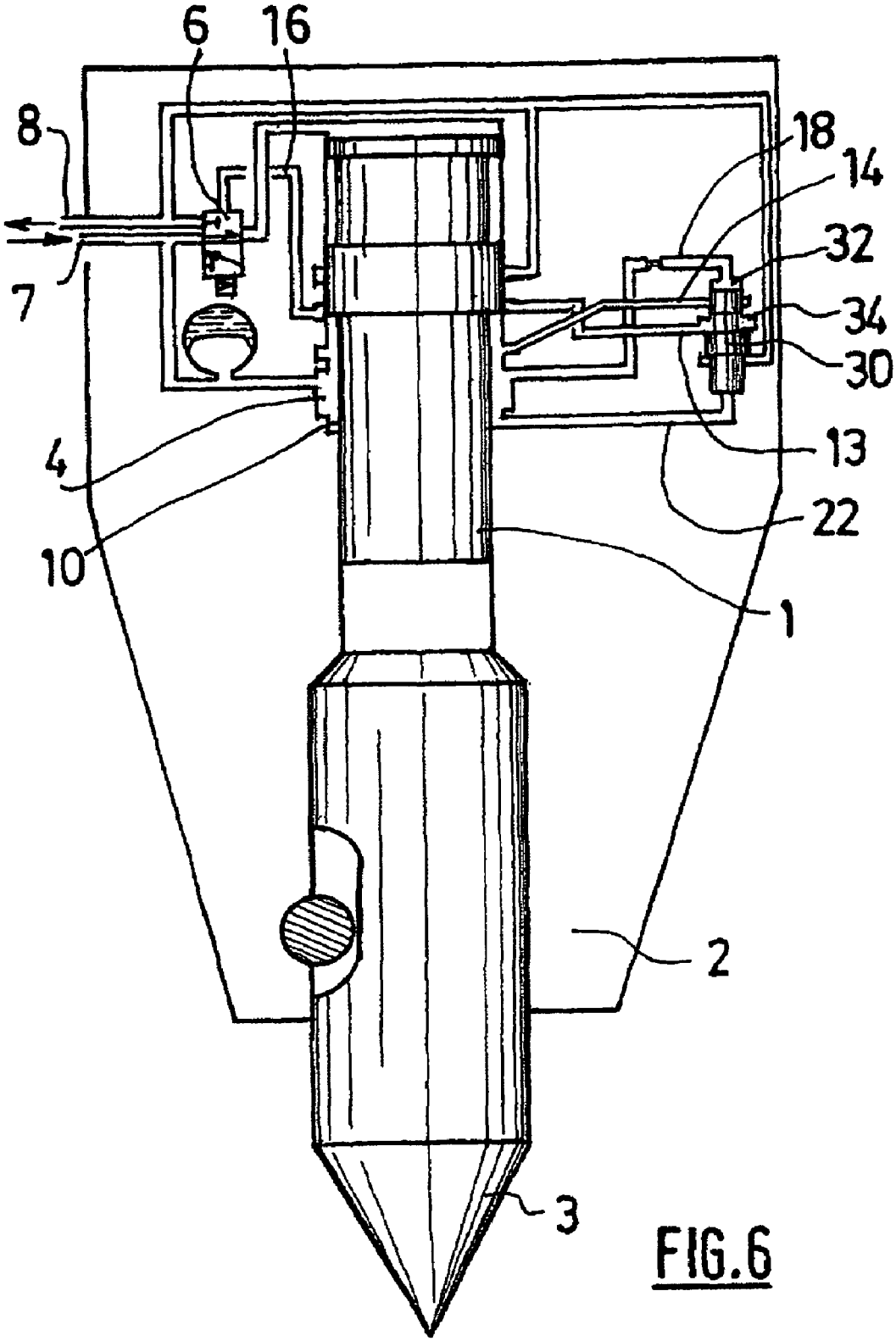
FIGS. 6, 7 and 8 represent views in longitudinal section of the apparatus of FIG. 5 in other operating positions.
Figure 7:
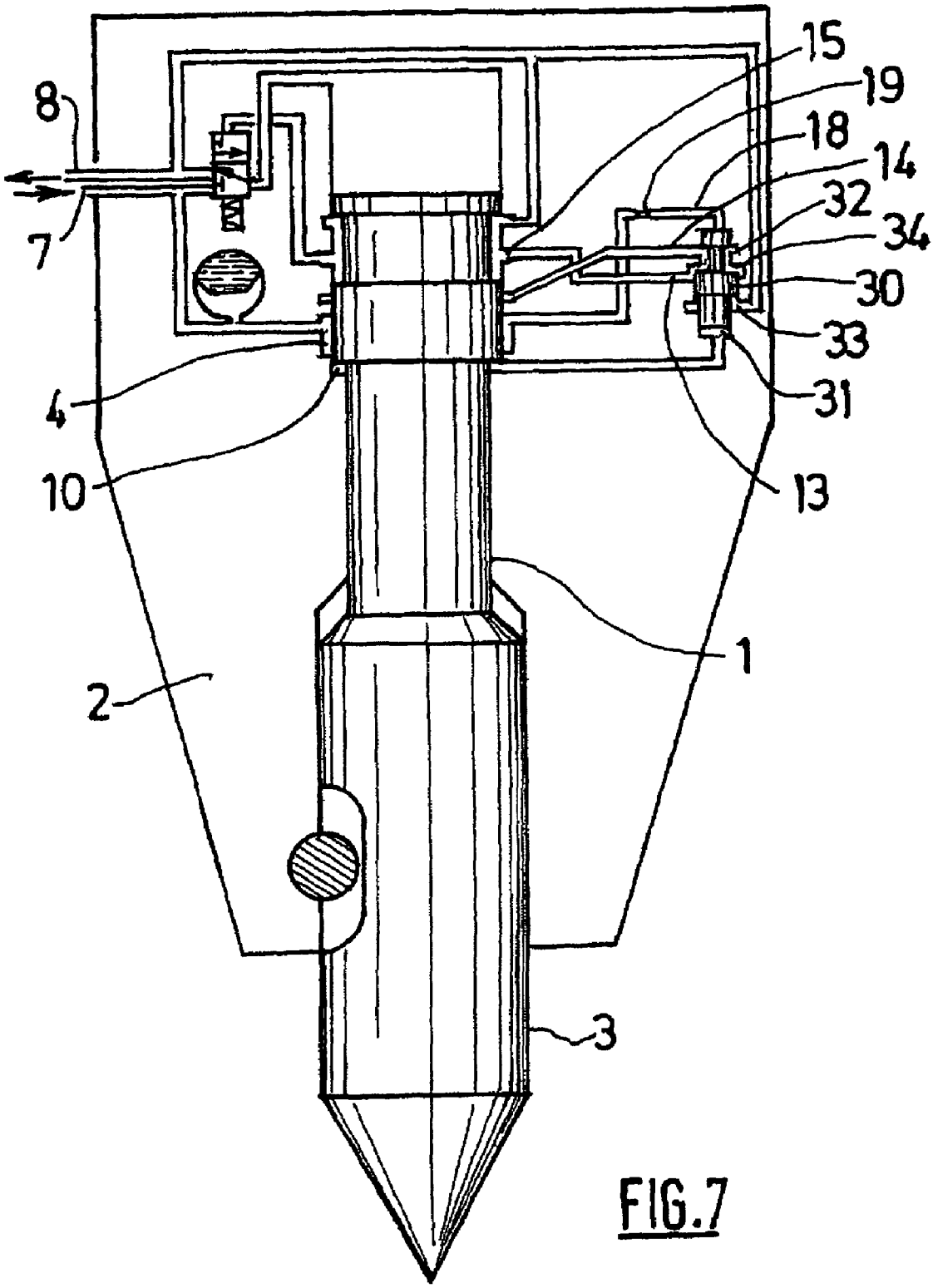
Figure 8:
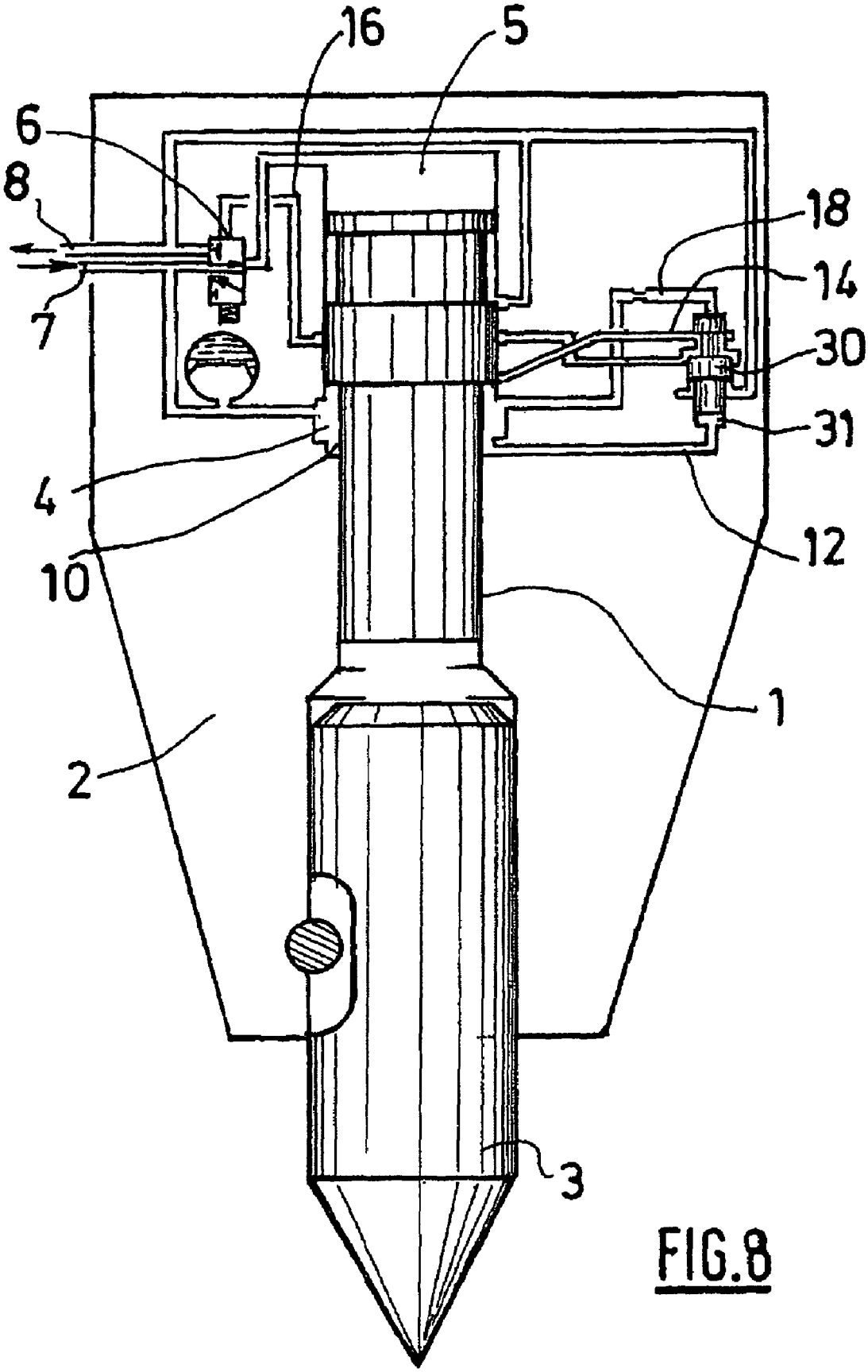
Figure 9:
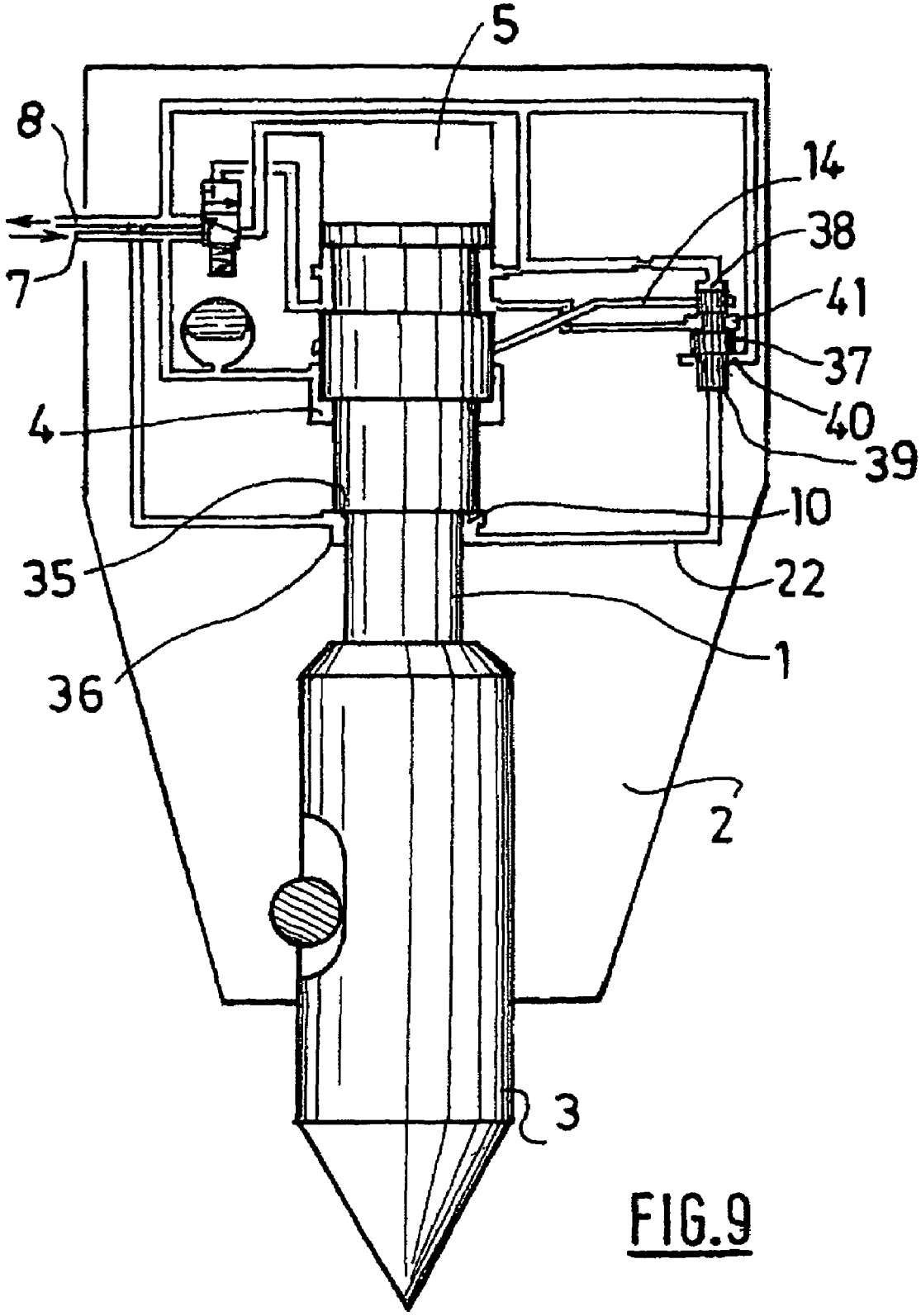
FIG. 9 represents a view in longitudinal section of another variant of the same apparatus.
Figure 10:
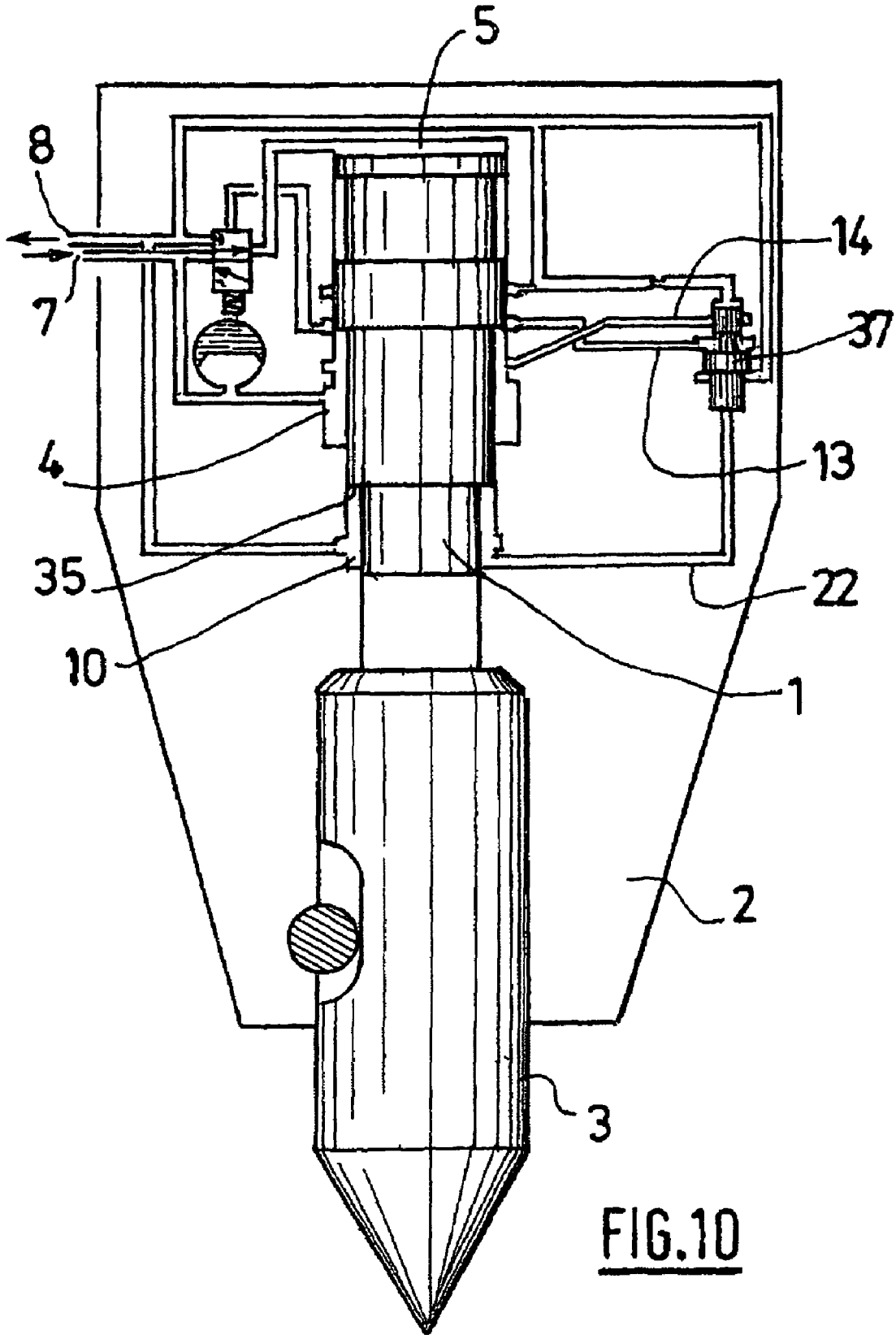
FIGS. 10, 11 and 12 represent views in longitudinal section of the apparatus of FIG. 9 in other operating positions.
Figure 11:
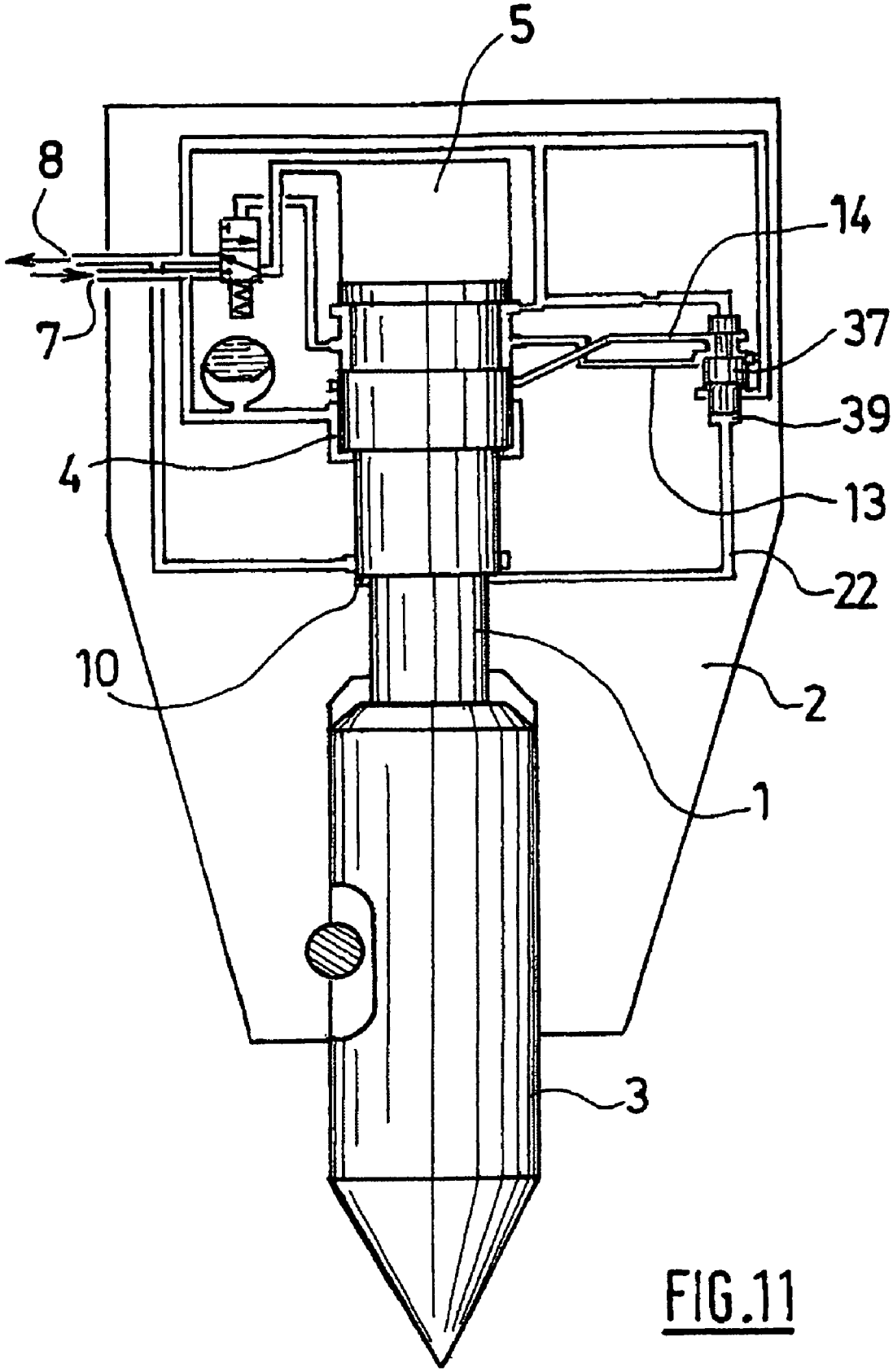
Figure 12:
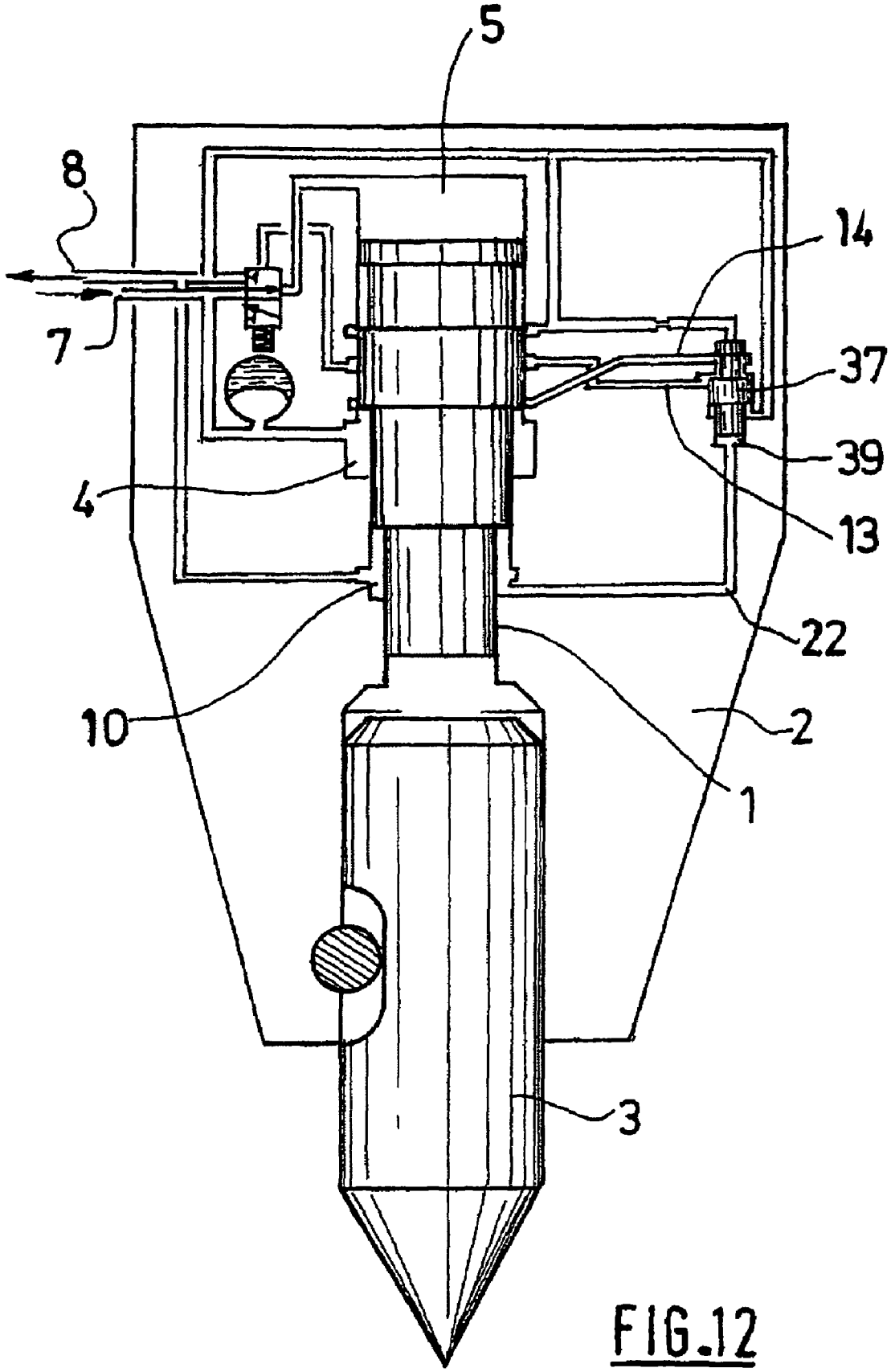

FIGS. 5 to 8 represent a variant of the apparatus which comprises a different stroke selection spool 30. FIGS. 5 and 6 represent respectively the apparatus when the tool 3 is close to its striking zone with the piston 1 beginning its upstroke and the piston beginning its accelerated downstroke. FIGS. 7 and 8 represent respectively the apparatus when the tool 3 is distant from its theoretical striking zone with the beginning of the upstroke of the piston 1 and the beginning of the downstroke of the piston 1.

According to this variant of the apparatus, the spool 30 delimits four chambers with the body 2. Two chambers 31 and 32 that are opposite and of identical cross section, the chamber 32 being constantly connected to the supply circuit via the channel 18 and the chamber 31 constantly connected to the braking chamber 10 via the channel 22. Finally, with the body 2, the spool 30 delimits two opposite annular chambers 33 and 34 with identical cross sections. The chamber 33 is constantly connected to the low-pressure circuit 8 of the apparatus. The chamber 34 is connected to the control circuit of the main directional flow valve 6 via the channels 13 and 16.

As above, the spool 30 will be moved by the pressure created in the chamber 10 when the piston 1 lengthens its strike stroke in soft ground, thereby determining short stroke operation. On the other hand, the return to the bottom position of the spool 30 will take place on each cycle when the chamber 34 is supplied with pressurized fluid via the control circuit 16, 13. Specifically, the chambers 31 and 32 subjected to the same pressure and of equal cross sections do not apply forces on the spool 30; on the other hand the respective pressures of the annular chambers 33 and 34 allow the unbalancing of the spool 30 downward according to the schematic representation.

FIGS. 9 to 12 represent a variant of the apparatus with an assembly of the piston 1 and body 2 which delimit three distinct chambers of which the annular braking chamber 10 is constantly connected to the return circuit 8. FIGS. 9 to 12 represent respectively the beginnings of upstroke and accelerated downstroke of the piston 1 in cases of hard uniform or soft nonuniform ground.

As above, when the edge 35 of the piston 1 passes the edge 36 of the chamber 10, the pressure in the chamber 10 increases since the fluid can flow only through the functional clearances.

In this configuration, the stroke selector spool 37 delimits with the body 2 four distinct chambers including two chambers 38 and 39 that are opposite and of equivalent cross sections, the chamber 38 still being connected to the return circuit 8, and the chamber 39 being connected to the braking chamber 10 via the channel 22. The other two annular chambers 40 and 41 are as above, respectively connected to the return circuit and to the control circuit. Pressurizing the control circuit on each cycle reinitializes the system.

Figure 13:
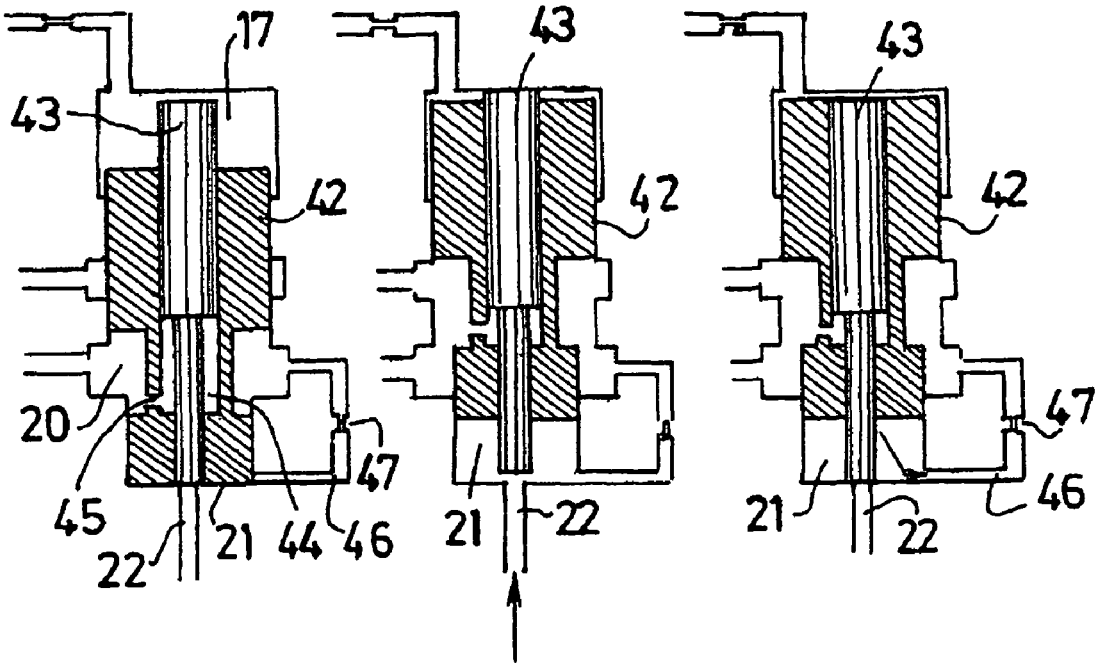
FIG. 13 represents views in longitudinal section of a variant of the stroke-regulation spool described in FIGS. 1 to 4 in three different operating phases.

FIG. 13 represents three operating phases of a variant of the stroke-regulation spool 12 described with reference to FIGS. 1 to 4. The spool 42 still determines three chambers 17, 20 and 21 with the bore in which it is mounted, as was the case for the spool 12. The spool 42 comprises a central bore in which is slidingly mounted a piston 43 comprising two successive sections of different diameters, a large diameter on the side of the chamber 17 and a small diameter on the side of the chamber 21. An annular chamber 44 is arranged in the central zone of the spool, between the latter and the piston 43, this annular chamber being permanently connected with the annular chamber 20 by means of an orifice 45. The annular chamber 20 is also connected to the chamber 21 via a channel 46 comprising a calibrated orifice 47, and the piston end with the small cross section is placed opposite the channel 22 connecting the chamber 21 to the braking chamber 10.

The piston 43 acts as a nonreturn valve which allows the injection of pressurized fluid between the channel 22 and the chamber 21 and, when it is pressing on the body 2, forces the fluid contained in the chamber 21 to escape via the channel 46 and the orifice 47 to the annular chamber 20. This gives a system that is independent of any negative pressure waves transmitted via the channel 22 during the repeated impacts on the tool 3.

Naturally the annular cross sections of the spool 42 and of the piston 43 are designed so that the latter move in the same pressure conditions as the spool 12 described with reference to FIGS. 1 to 4.

Figure 14:
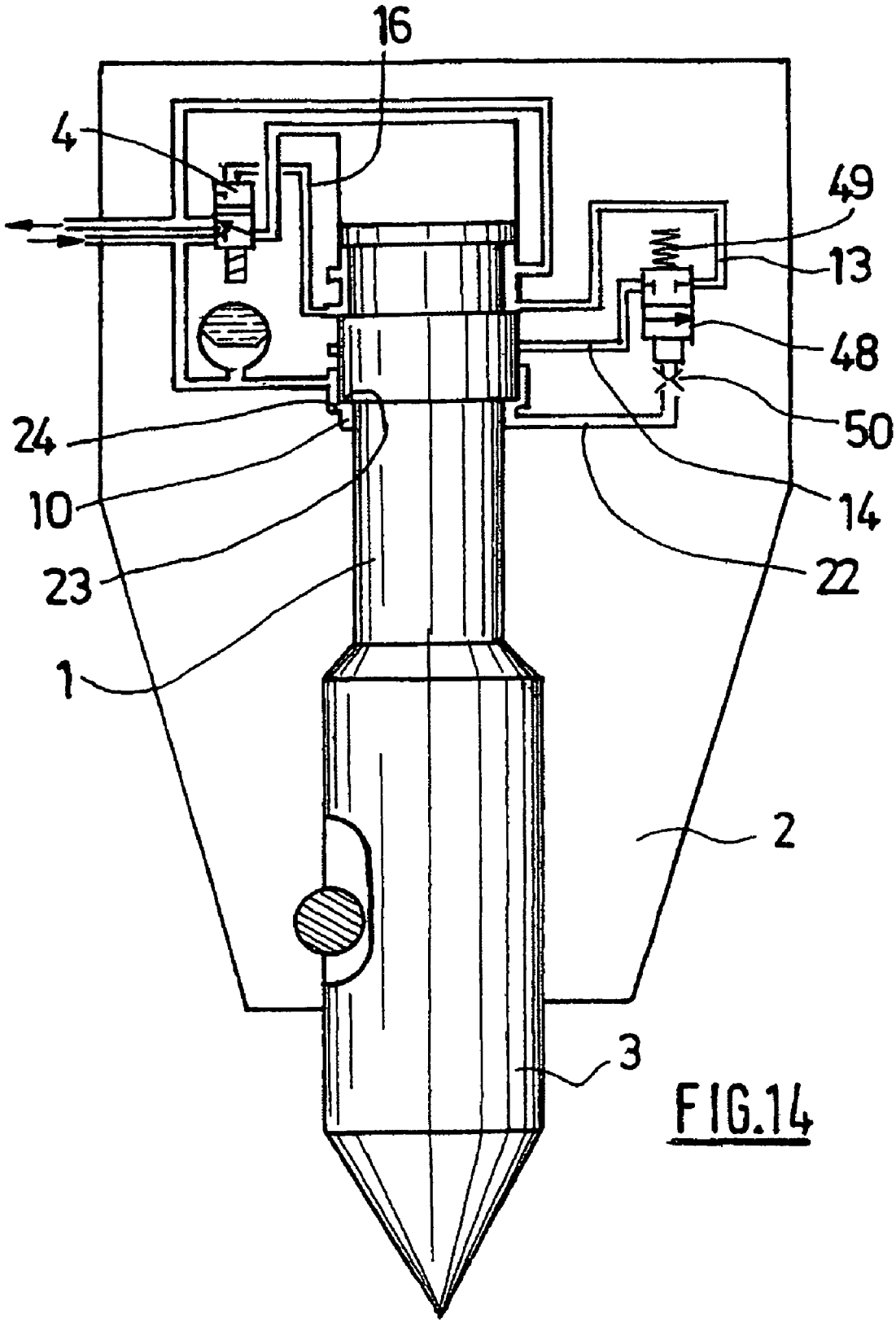
FIGS. 14 to 16 represent views in longitudinal section of other variants of the same apparatus.

FIG. 14 represents the operation of another variant of the stroke regulation spool 12 described with reference to FIGS. 1 to 4. In this case, the spool 48 comprises a first face subjected to the action of a spring 49 and a second face subjected to the pressure prevailing in the braking chamber 10. A calibrated orifice 50, consisting of a nozzle, is placed on the channel 22 connecting the braking chamber and the spool 48. The speed of the spool 48 is limited in both directions by the calibrated orifice 50, and the spool is returned to its original position by the spring 49.

Figure 15:
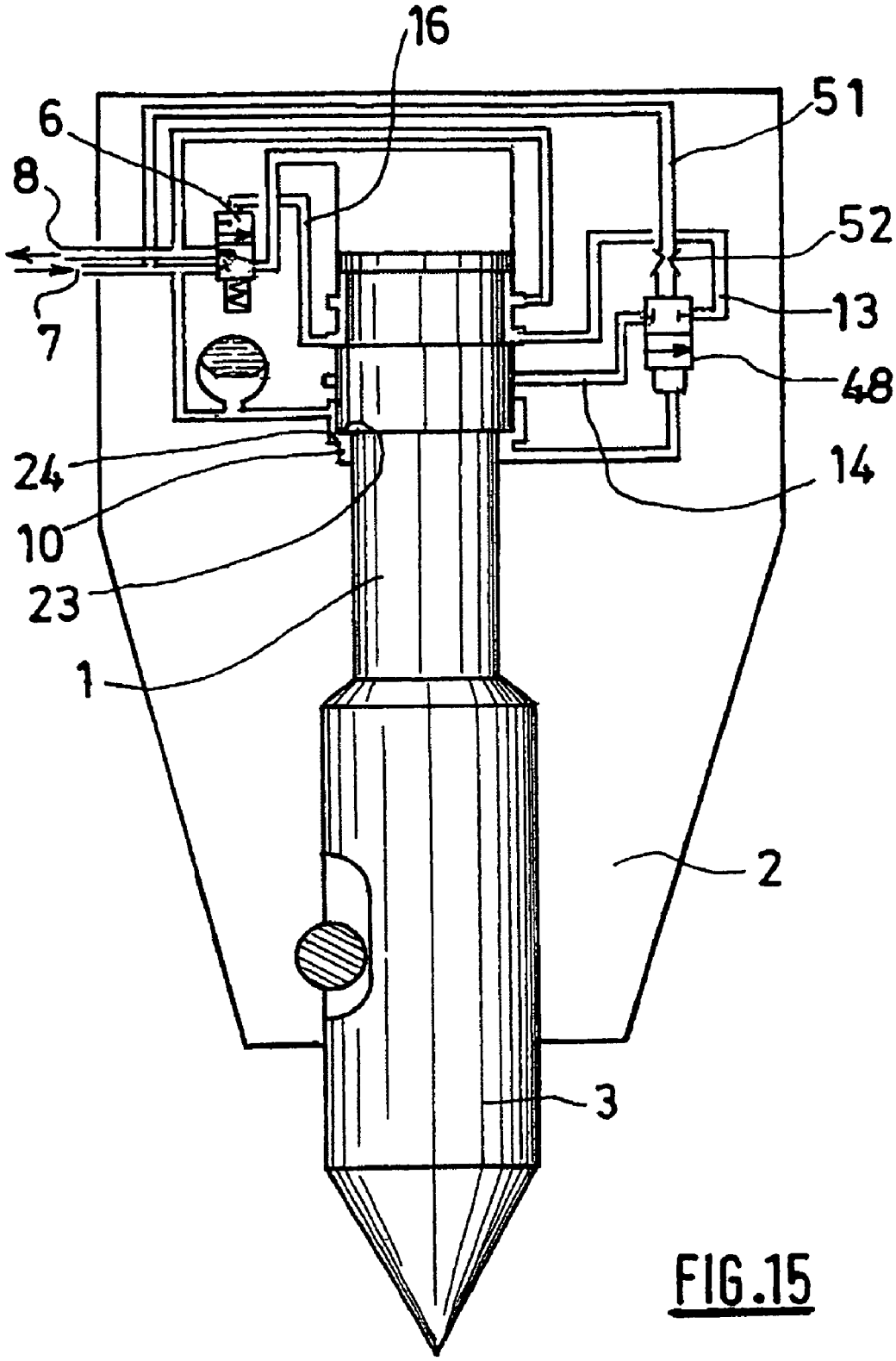

FIG. 15 represents a variant of the apparatus of FIG. 14 in which the spring 49 has been replaced by a hydraulic return supplied via a channel 51 comprising a calibrated orifice 52 which limits the speed of movement of the spool 48.

Figure 16:
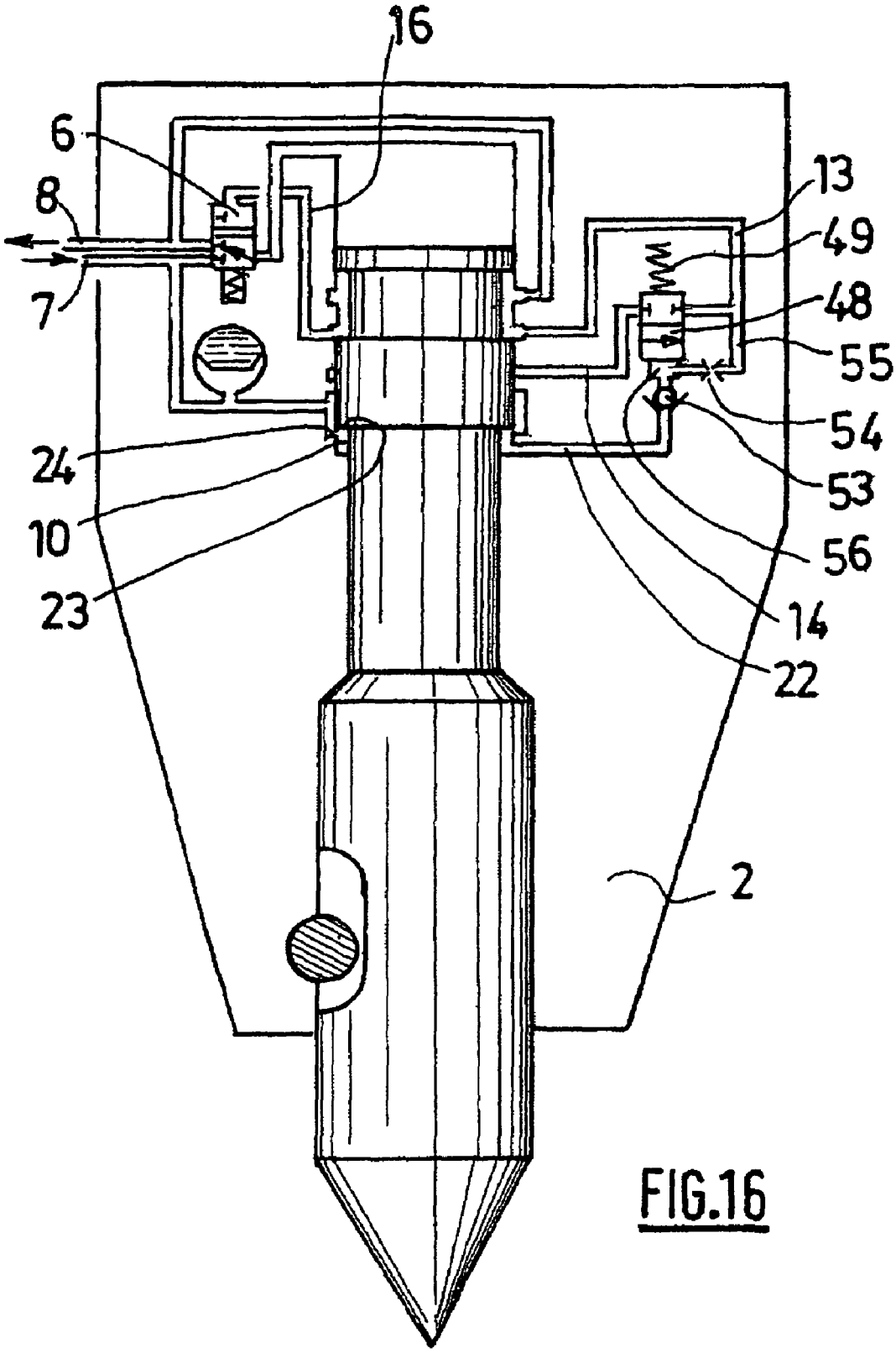

FIG. 16 represents another variant of the apparatus of FIG. 14 in which a movement of the spool 48 is caused by a circulation of oil in the channel 22 through a nonreturn valve 53 and the spool is returned by a spring 49. The speed of the spool 48 is limited by a nozzle 54 situated on a channel 55 connecting the control chamber 56 of the spool 12 to the channel 13.

Figure 17:
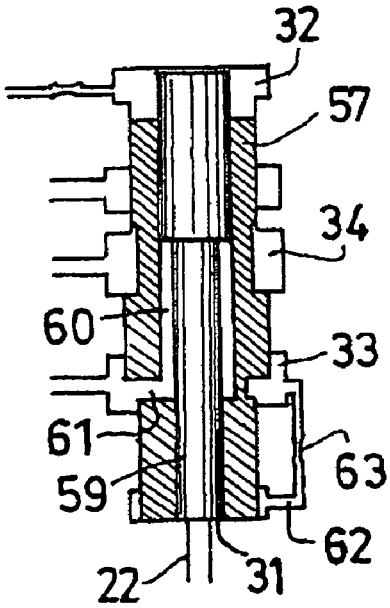
FIGS. 17 and 18 represent views in longitudinal section of two variants of the regulation spool described in FIGS. 5 to 8.
Figure 18:
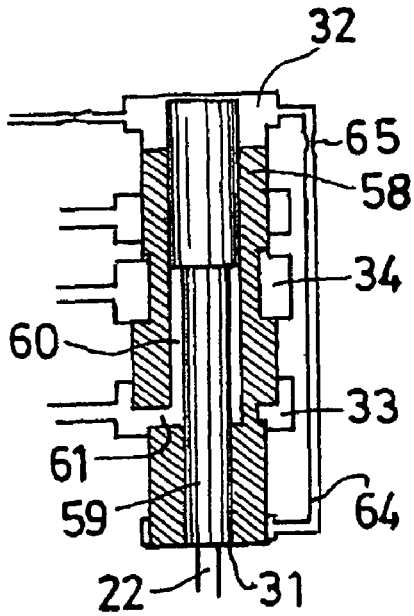

FIGS. 17 and 18 represent two variants of the regulation spool 30 described with reference to FIGS. 5 to 8. The spools 57 and 58 still determine four chambers 31, 32, 33 and 34 with the bores in which they are mounted, as was the case for the spool 30.

The spool 57 comprises a central bore in which is slidingly mounted a piston 59 comprising two successive sections of different diameters, a large diameter on the side of the chamber 32 and a small diameter on the side of the chamber 31. An annular chamber 60 is arranged in the central zone of the spool, between the latter and the piston 59, this annular chamber being permanently connected with the annular chamber 33 by means of an orifice 61. The annular chamber 33 is also connected to the chamber 31 via a channel 62 comprising a calibrated orifice 63, and the piston end with the small cross section is placed opposite the channel 22 connecting the chamber 31 to the braking chamber 10.

The spool 58 differs from the spool 57 essentially by the fact that the chamber 31 is not connected to the chamber 33 via the channel 62 but is connected to the chamber 32 via a channel 64 comprising a calibrated orifice 65.

As for the piston 43, the piston 59 acts as a nonreturn valve which allows the injection of pressurized fluid.

It goes without saying that the invention is not limited solely to the embodiments of this apparatus that have been described above as examples; on the contrary it covers all the variant embodiments thereof.

The invention claimed is:

1. Percussion apparatus driven by a pressurized incompressible fluid, comprising:

a body inside which are arranged two coaxial bores:

one bore serving as a slidable mounting of a tool, and another bore that is stepped, comprising different successive cross sections, forming a piston cylinder for a striking piston having a stepped configuration, the striking piston moving in a reciprocating manner inside the piston cylinder and coming, during each cycle, to strike the tool, the stepped configuration of the striking piston delimiting with the piston cylinder at least one top chamber and a bottom chamber supplied sequentially with an incompressible fluid under high pressure, under action of a directional flow valve, a network of channels leading into the piston cylinder, of which some of the channels, based on their function, are connected through the directional flow valve to at least one of a high-pressure network and a low-pressure network, depending on an operating cycle of the striking piston, a control device that varies a stroke of the striking piston between a long stroke and a short stroke, the control device being connected on one hand to the directional flow valve and on another hand to at least one channel leading into the piston cylinder of the striking piston to be placed in fluid communication with the bottom chamber during upward movement of the striking piston, and a braking chamber placed in a zone of the piston cylinder situated on a side of the tool, that is closed by a shoulder of the striking piston when the striking piston moves past a theoretical striking position, wherein the control device comprises a control device cylinder, into which at least a first channel and a second channel lead, the first channel also leading into the piston cylinder of the striking piston and the second channel being connected to the directional flow valve, a spool being mounted in the control device cylinder, a first face of the spool being situated in a first chamber permanently subjected to a determined pressure, and a second face of the spool being situated in a second chamber connected to the braking chamber by a third channel opening in the braking chamber.

2. The apparatus according to claim 1, wherein the first face of the spool of the control device is subjected to an action of a spring while the second face is subjected to pressure prevailing in the braking chamber, the braking chamber being in communication with the bottom chamber arranged in the piston cylinder, when the striking piston has not moved past the theoretical striking position, the bottom chamber being connected to the high-pressure network.

3. The apparatus according to claim 2, wherein a calibrated orifice, consisting of a nozzle, is placed on the third channel connecting the braking chamber and the second chamber of the control device.

4. The apparatus according to claim 2, wherein a nonreturn valve is placed on the third channel connecting the braking chamber and the second chamber of the control device, and the second chamber is connected via a channel comprising a calibrated orifice, consisting of a nozzle, to the second channel connected to the directional flow valve.

5. The apparatus according to claim 1, wherein the first chamber of the control device is permanently connected to the high-pressure network via a channel comprising a calibrated orifice consisting of a nozzle.

6. The apparatus according to claim 5, wherein the first chamber of the control device is permanently connected to the high-pressure network via a channel leading into the bottom chamber of the piston cylinder of the striking piston.

7. The apparatus according to claim 5, wherein the first chamber of the control device is permanently connected to the high-pressure network via a channel connected to a supply source with fluid under high pressure.

8. The apparatus according to claim 1, wherein the control device cylinder comprises several different successive cross sections, and the spool comprises several different successive cross sections, the spool and the control device cylinder delimiting a control device annular chamber permanently connected to the directional flow valve, the spool being arranged to allow, during movement of the spool under an effect of the fluid originating from the braking chamber, placing in communication of the control device annular chamber with other channels leading into the piston cylinder of the striking piston.

9. The apparatus according to claim 8, wherein the spool of the control device comprises a central bore in which is slidingly mounted a central piston comprising two successive sections of different diameters, a large diameter on a side of the first chamber and a small diameter on a side of the second chamber, a central bore annular chamber being arranged in a central zone of the spool, between the spool and the central piston, the central bore annular chamber being permanently connected with the control device annular chamber connected to the directional flow valve, the control device annular chamber also being connected to the second chamber via a channel comprising a calibrated orifice, and a piston end of the central piston with a small cross section being placed opposite the third channel connecting the second chamber to the braking chamber.

10. The apparatus according to claim 8, wherein the spool of the control device comprises a central bore in which is slidingly mounted a central piston comprising two successive sections of different diameters, a large diameter on a side of the first chamber and a small diameter on a side of the second chamber, a central bore annular chamber being arranged in a central zone of the spool, between the spool and the central piston, the central bore annular chamber being permanently connected with an annular chamber of the spool constantly connected to the low-pressure network, the annular chamber also being connected to the second chamber via a channel comprising a calibrated orifice, and a piston end of the central piston with a small cross section being placed opposite the third channel connecting the second chamber to the braking chamber.

11. The apparatus according to claim 8, wherein the spool of the control device comprises a central bore in which is slidingly mounted a central piston comprising two successive sections of different diameters, a large diameter on a side of the first chamber and a small diameter on a side of the second chamber, a central bore annular chamber being arranged in a central zone of the spool, between the spool and the central piston, the central bore annular chamber being permanently connected with an annular chamber of the spool constantly connected to the low-pressure network, the second chamber being connected to the first chamber via a channel comprising a calibrated orifice and a piston end of the central piston with a small cross section being placed opposite the third channel connecting the second chamber to the braking chamber.

* * * * *